US006261740B1

(12) United States Patent
Nguyen et al.

(10) Patent No.: US 6,261,740 B1
(45) Date of Patent: Jul. 17, 2001

(54) PROCESSLESS, LASER IMAGEABLE LITHOGRAPHIC PRINTING PLATE

(75) Inventors: My T. Nguyen, Kirkland (CA); Shashikant Saraiya, Parlin, NJ (US); Ken-Ichi Shimazu, Briarcliff Manor, NY (US); S. Peter Pappas, Wood Ridge, NJ (US); Robert Hallman, Palinskle Park, NJ (US); Ajay Shah, Livingston, NJ (US); Omkar J. Natu, Warren, NJ (US); Jayanti Patel, Woodcliff Lake, NJ (US)

(73) Assignee: Kodak Polychrome Graphics, LLC, Norwalk, CT (US)

( * ) Notice: Subject to any disclaimer, the term of this patent is extended or adjusted under 35 U.S.C. 154(b) by 0 days.

(21) Appl. No.: 09/244,339

(22) Filed: Feb. 4, 1999

Related U.S. Application Data

(63) Continuation-in-part of application No. 08/922,714, filed on Sep. 2, 1997, now abandoned.

(51) Int. Cl.[7] ..... G03C 1/76

(52) U.S. Cl. ..... 430/271.1; 430/272.1; 430/278.1; 430/281.1; 430/302

(58) Field of Search ..... 430/271.1, 272.1, 430/278.1, 302, 281.1, 303

(56) References Cited

U.S. PATENT DOCUMENTS

| | | | | |
|---|---|---|---|---|
| 3,181,461 | | 5/1965 | Fromson | 101/149.2 |
| 3,559,578 | * | 2/1971 | Haas et al. | 101/467 |
| 3,635,709 | | 1/1972 | Kobayashi | 96/33 |
| 3,891,439 | | 6/1975 | Katz et al. | 96/49 |
| 3,900,320 | | 8/1975 | Rolker et al. | 96/35.1 |
| 4,153,461 | | 5/1979 | Berghauser et al. | 96/75 |
| 4,183,788 | * | 1/1980 | Fromson et al. | 430/278 |
| 4,457,971 | * | 7/1984 | Cadwell et al. | 428/323 |
| 4,555,475 | | 11/1985 | Gamson et al. | 430/309 |
| 4,576,743 | | 3/1986 | Kita et al. | 252/524 |
| 4,708,925 | | 11/1987 | Newman | 430/270 |
| 5,085,972 | | 2/1992 | Vogel | 430/270 |
| 5,281,509 | | 1/1994 | Murakata et al. | 430/207 |
| 5,286,612 | | 2/1994 | Tefler | 430/335 |
| 5,340,699 | | 8/1994 | Haley et al. | 430/302 |
| 5,372,907 | | 12/1994 | Haley et al. | 430/157 |
| 5,372,915 | | 12/1994 | Haley et al. | 430/302 |
| 5,441,850 | | 8/1995 | Marshall et al. | 430/336 |
| 5,466,557 | | 11/1995 | Haley et al. | 430/278 |
| 5,491,046 | | 2/1996 | DeBoer et al. | 430/302 |
| 5,503,953 | * | 4/1996 | Ito et al. | 430/49 |
| 5,656,410 | * | 8/1997 | Van Damme et al. | 430/256 |
| 5,707,775 | | 1/1998 | Deprez et al. | 430/232 |
| 5,776,604 | | 7/1998 | Lu et al. | 428/343 |
| 5,981,135 | * | 11/1999 | Koes et al. | 430/165 |
| 5,994,023 | * | 11/1999 | Van Damme et al. | 430/176 |

FOREIGN PATENT DOCUMENTS

| | | |
|---|---|---|
| 0 672 954 A2 | 9/1995 | (EP) . |
| 0 689 096 A1 | 12/1995 | (EP) . |
| 0819980 | 1/1998 | (EP) . |
| PCT/GB95/02774 | 7/1996 | (WO) . |
| WO 98/21038 | 5/1998 | (WO) . |
| WO 98/52768 | 11/1998 | (WO) . |

* cited by examiner

*Primary Examiner*—Janet Baxter
*Assistant Examiner*—Barbara Gilmore
(74) *Attorney, Agent, or Firm*—Ratner & Prestia

(57) ABSTRACT

A lithographic printing surface is prepared using a thermal lithographic printing plate which requires no chemical development to remove areas of the imaged plate. The processless thermal lithographic printing plate has a sheet substrate; a hydrophilic layer on the sheet substrate; and a thermally sensitive imaging layer on the hydrophilic layer. The hydrophilic layer contains about 30 weight % of an aluminosilicate or clay, and preferably has an exterior surface which is micro-porous. The imaging layer preferably is micro-porous. The imaging layer is exposed imagewise using infrared laser radiation to produce an imaged layer. The imaged layer is treated with a conditioner liquid to produce a lithographic printing surface. By this method, the printing plate can be digitally imaged by infrared laser radiation so that the exposed areas become ink receptive and the non-exposed areas repel ink after simple treatment with a conditioner such as an aqueous surfactant solution such as a fountain solution containing an amphoteric surfactant.

63 Claims, No Drawings

PROCESSLESS, LASER IMAGEABLE LITHOGRAPHIC PRINTING PLATE

CROSS REFERENCES TO RELATED APPLICATIONS

This application is a continuation-in-part of U.S. patent application Ser. No. 08/922,714, filed Sep. 2, 1997 by My T. Nguyen et al., and entitled "PROCESSLESS, LASER IMAGEABLE LITHOGRAPHIC PRINTING PLATE" abandoned Mar. 16, 1999.

BACKGROUND OF THE INVENTION

1. Field of the Invention

This invention relates to negative-working, thermally imageable, lithographic printing plates and their process of use. More particularly, this invention relates to lithographic printing plates which can be digitally imaged by infrared laser light.

2. Description of Related Art

Conventional lithographic printing plates typically have a radiation sensitive, oleophilic image layer coated over a hydrophilic underlayer. The plates are imaged by imagewise exposure to actinic radiation to produce exposed areas which are either soluble (positive working) or insoluble (negative working) in a developer liquid. During development of the imaged plate, the soluble areas are removed by the developer liquid from underlying hydrophilic surface areas to produce a finished plate with ink receptive oleophilic image areas separated by complimentary, fountain solution receptive hydrophilic areas. During printing, a fountain solution and ink are applied to the imaged plate. The fountain solution is applied to the imaged plate to wet the hydrophilic areas, so as to insure that only the oleophilic image areas will pick up ink for deposition on the paper stock as a printed image. Conventional lithographic printing plates typically have been imaged using ultraviolet radiation transmitted imagewise through a suitable litho film in contact with the surface of the printing plate.

With the advent of digitally controlled imaging systems using infrared lasers, printing plates which can be imaged thermally have been developed to address the emerging industry need. In such thermally imaged systems the radiation sensitive layer typically contains a dye or pigment which absorbs the incident infrared radiation and the absorbed energy initiates the thermal reaction to produce the image. However, each of these thermal imaging systems requires either a pre- or post-baking step to complete image formation , or blanket pre exposure to ultraviolet radiation to activate the layer.

Examples of radiation sensitive compositions and their use in making lithographic printing plates are disclosed in U.S. Pat. No. 4,708,925; 5,085,972; 5,286,612; 5,372,915; 5,441,850; 5,491,046; 5,340,699; and 5,466,557; and European Patent Application 0 672 954 A2.

Each of the disclosed radiation sensitive lithographic printing plates requires a development step typically with a highly alkaline developer which is prone to reaction with atmospheric carbon dioxide. After non printing areas are removed the developed plate typically requires rinsing and drying prior to mounting on the printing press. In order to take full advantage of current digitally controlled imaging systems there is a need to reduce or eliminate the time required for plate development so that an imaged plate could be directly used on a printing press.

SUMMARY OF THE INVENTION

These needs are met by the processless lithographic printing plate of this invention which is a negative-working, thermally imageable, lithographic printing plate comprising:

(a) a sheet substrate;

(b) a hydrophilic layer applied to the sheet substrate, wherein the hydrophilic layer comprises about 30 weight % or more of an aluminosilicate or a clay based on the weight of the hydrophilic layer, and wherein the hydrophilic layer has a coating weight of about 5 g/m$^2$ or more; and (c) an imaging layer applied to the hydrophilic layer, wherein the imaging layer comprises a thermally sensitive composition.

A further embodiment of this invention is a method for preparing a lithographic printing surface consisting essentially of the steps:

A. providing a negative-working, thermally imageable, lithographic printing plate comprising:

(a) a sheet substrate;

(b) a hydrophilic layer applied to the sheet substrate, wherein the hydrophilic layer comprises about 30 weight % or more of an aluminosilicate or a clay based on the weight of the hydrophilic layer, and wherein the hydrophilic layer has a coating weight of about 5 g/m$^2$ or more; and, (c) an imaging layer applied to the hydrophilic layer, wherein the imaging layer comprises a thermally sensitive composition;

B. imagewise exposing the imaging layer to infrared radiation to produce an imaged layer; and C. treating the imaged layer with a conditioner liquid to produce a lithographic printing surface.

In a preferred embodiment of this invention, the hydrophilic layer has an outer micro-porous surface, and the imaging layer is micro-porous.

DETAILED DESCRIPTION OF THE INVENTION

This invention relates to processless thermal lithographic printing plates which can be digitally imaged by infrared laser radiation having a wavelength between 700 and 1300 nm. The thermal lithographic printing plates described herein do not require a chemical development process to remove areas of the imaged plate. Rather, upon exposure to infrared laser radiation, the exposed imaged areas become ink receptive and the non-exposed, non-image areas repel ink after simple treatment with a conditioner such as a fountain solution.

The processless thermal lithographic printing plates of this invention are comprised of a sheet substrate; a hydrophilic layer applied to the sheet substrate; and a thermally sensitive imaging layer applied to the hydrophilic layer. The surface of the hydrophilic layer preferably is micro-porous and the imaging layer preferably is micro-porous. The following detailed description of the invention will describe the preferred embodiment wherein the hydrophilic layer surface and the imaging layer are micro-porous, but is not intended to be limited thereby.

In one embodiment of this invention the hydrophilic layer, which is applied to the sheet substrate, comprises about 30 weight % or more of an aluminosilicate or a clay based on the weight of the hydrophilic layer, and has a coating weight of about 5 g/m$^2$ or more; and the imaging layer, which is applied to the hydrophilic layer, comprises a thermally sensitive composition and preferably is micro-porous.

In a specific embodiment of this invention the lithographic printing plate comprises: (a) a sheet substrate; (b) a hydrophilic layer applied to the sheet substrate, wherein the hydrophilic layer has an outer surface which is micro-porous and wherein the hydrophilic layer consists essentially of aluminosilicate; and (c) a micro-porous imaging layer applied to the hydrophilic layer, wherein the imaging layer consists essentially of (1) an acid catalyzed, crosslinking resin system; (2) a thermally-activated acid generator; (3) an infrared absorbing compound; and optionally, (4) an indicator dye.

As used herein the term "micro-porous" is intended to include layer surfaces which contain open pores which are a fraction of a micrometer or more in diameter. Such micro-porous surfaces are readily observed in electron micrographs of the surface, such as by use of 5 KV electron and 2000 magnification. Larger pores in hydrophilic surfaces may also be detected using conventional acoustic studies to measure the rate of penetration of water (or ink) into the hydrophilic surface.

Sheet Substrate

Any dimensionally stable sheet material may be used to support the lithographic plate structure of this invention. Thus the substrate may be polymeric films such as polyester films; metal sheets such as aluminum; paper product sheets; and the like. Each of these substrate types may be coated with ancillary layers to improve interlayer adhesion; thermal isolation, particularly for metal substrates; and the like.

A preferred polymeric substrate is a sheet of polyester film such as polyethylene terephthalate, although other polymeric films and composites may also be used such as polycarbonate sheets; and the like. A preferred substrate of this type is a polyethylene terephthalate substrate such as that employed in Myriad and Omega Plus II offset substrates. The Myriad substrate is available from Xante Corporation, Mobile, Ala.; and the Omega Plus II substrate is available from Autotype Americas, Inc., Schaumburg, Ill. Myriad and Omega Plus II polyester offset substrates consist of a polyester substrate which has been treated to provide a hydrophilic surface.

A preferred metal substrate is aluminum particularly for such plates having long press life. The substrate surface may be treated or sub-coated with a material which provides a hydrophilic character to the substrate surface for use with a fountain solution. Thus an aluminum substrate may be electrochemically treated to provide a grained surface and enhance hydrophilicity of the surface for use with fountain solutions.

Substrates can have any desired thickness that would be useful for a given printing application, and to sustain the wear of a printing press and thin enough to wrap around a printing form, for example from about 100 to about 500 $\mu$m in thickness. A preferred polymeric substrate composed of polyethylene terephthalate can have a thickness from about 100 to about 200 $\mu$m.

Hydrophilic Layer

The lithographic plate of this invention has a hydrophilic layer which has a micro-porous surface, and contains about 30 weight % or more of an aluminosilicate or a clay based on the weight of the hydrophilic layer, and has a coating weight of about 5 g/m$^2$ or more, and typically about 10 g/m$^2$ or more. Preferably, the hydrophilic layer has a coating weight of about 12 g/m$^2$ or more. In particular, the surface of the hydrophilic layer of this invention is micro-porous and strongly adheres to both the underlying substrate as well as the overlying imaging layer. A typical hydrophilic layer contains an aluminosilicate or a clay and a crosslinked hydrophilic binder which is a product of a reaction of a water-soluble binder with a hardening agent. In a preferred embodiment this layer also includes one or more colloidal silicas, amorphous silicas, and surfactants.

A particular hydrophilic layer which possesses these unique features is the hydrophilic surface of the Myriad polyester offset printing plate identified above. The hydrophilic surface of the Myriad product was analyzed using an FT-IR spectrophotometer and identified as alumino silicate corresponding to $Al_2O_3 \cdot 2SiO_2 \cdot 2H_2O$. An electron micrograph of that hydrophilic surface at 5 KV electrons and 2000 magnification revealed that the surface is micro-porous having pores which are a fraction of a micrometer. The Myriad product was determined to have an average surface roughness of about 1.0 to about 1.1 micrometers, using conventional roughness measurement methods.

A preferred hydrophilic layer which possesses these unique features contains a clay, silica and a crosslinked hydrophilic binder. In particular, the layer, typically is formed from 30–80 wt. % clay; 15–50 wt. % colloidal silica; 2–15 wt. % water soluble polymeric binder; 1–10 wt. % hardening agent; 0.01–1 wt. % surfactant; and 0.1–10 wt. % of amorphous silica. Preferably, the hydrophilic layer is formed from 50–70 wt. % clay; 20–40 wt. % colloidal silica; 5–12 wt. % water soluble polymeric binder; 1–5 wt. % hardening agent; 0.1–0.5 wt. % surfactant; and 1–3 wt. % of amorphous silica. In the most preferred embodiment the hydrophilic layer is formed from about 51–62 wt. % clay; about 18–26 wt. % colloidal silica; about 7.5–8 wt. % water soluble polymeric binder; about 4 wt. % hardening agent, all percentages being based on the total dry weight of the layer. The remainder of the layer can be composed of the other addenda described above. The coating weight for such layers typically is 12–16 g/m, and the layers have a surface roughness from about 0.6 to 1.1 $\mu$m.

Useful clays may be either synthetic or naturally occurring materials. Clays are predominantly composed of hydrous phyllosilicates, referred to as clay minerals. These clay minerals are hydrous silicates of Al, Mg, K, and Fe, and other less abundant elements. Such clays include, but are not limited to, kaolin (aluminum silicate hydroxide) which is to be understood to include the minerals kalinite, dickite, nacrite and halloysite-endellite. Other useful clays include, but are not limited to, the serpentine clays (including the minerals chrysotile, amersite, cronstedite, chamosite and garnierite), the montmorillonites (including the minerals beidellite, nontronite, hextorite, saponite and sauconite), the illite clays, a glauconite, a chlorite, a vermiculite, a bauxite, an attapulgite, a sepiolite, a palgorskite, a corrensite, an allophane, an imogolite, a diaspore, a boehmite, a gibbsite, a cliachite, and mixtures thereof. In addition, synthetic clays such as laponites and hydrotalcites, (a chemical composition comprising magnesium aluminum hydroxy carbonate hydrate) may be used. Kaolin is preferred. Mixtures of these clays can also be used if desired. Such clays can be obtained from a number of commercial sources including for example, ECC International and Southern Clay Products. Examples of commercially available clays include: TEX 540 clay, (a mixture of metal oxides having aluminum oxide 38.5% and silicon oxide 45.3%, less than 1% each of sodium, titanium, calcium, and an average particle size of 4–6 $\mu$; available from ECC International); kaolin (china) clay, (a mixture of metal oxides having aluminum oxide 26% and silicon oxide 25%, and an average particle size of 0.4 $\mu$; available from Aldrich); kaolin clay, (a mixture of metal oxides having aluminum oxide 34% and silicon oxide 51%, and an average particle size of 1$\mu$; available from Across); and the like.

Water-soluble binders which are useful in preparing the hydrophilic layer, include both inorganic and organic binder materials such as, but not limited to, gelatin (and gelatin derivatives known in the photographic art), water-soluble cellulosic materials (for example hydroxypropylcellulose, hydroxyethylcellulose, hydroxypropylmethylcellulose and carboxymethylcellulose), water-soluble synthetic or naturally occurring polymers (for example a polyvinyl alcohol, poly(vinyl pyrrolidones), polyacrylamides, water absorbent starches, dextrin, amylogen, and copolymers derived from vinyl alcohol, acrylamides, vinyl pyrrolidones and other water soluble monomers), gum arabic, agar, algin, carrageenan, fucoidan, laminaran, cornhull gum, gum ghatti, guar gum, karaya gum, locust bean gum, pectin, and the like. Cellulosic materials are preferred. Mixtures of any of these materials can be used for the preparation of the layer. As used herein the term "water-soluble" is intended to mean that the material can form a solution in water having 1 weight % or greater of the material. A preferred cellulosic binder of this type is Methocel K100LV which is 5% hydroxypropyl methylcellulose aqueous solution, available from Dow Chemical.

One or more hardening agents (also identified as crosslinking agents) may be used to produce the crosslinked hydrophilic binder in the hydrophilic layer. Useful hardening agents include, but are not limited to, tetraalkoxysilanes (such as tetraethoxysilane and tetramethoxysilane) and silanes having two or more hydroxy groups, alkoxy groups, acetoxy groups, (including but not limited to 3-aminopropyltrihydroxy-silane, glycidoxypropyltriethoxysilane, 3-aminopropylmethyldihydroxysilane, 3-(2-aminoethyl) aminopropyl-trihydroxysilane, N-trihydroxysilylpropyl-N, N, N-trimethyl-ammoniumchloride, trihydroxysilylporopanesulfonic acid and salts thereof). Of these hardening agents 3-aminopropyltrihydroxysilane, glycidoxypropyltriethoxy-silane or tetramethoxysilane are preferred.

When colloidal silica is present in the hydrophilic layer, it can be obtained from a number of commercial sources, for example as LUDOX SM-30 from DuPont, and as Nalco® 2326 from Nalco Corporation.

The hydrophilic layer may contain one or more surfactants used in applying the layer to the substrate. Useful coating surfactants include CT-121 (Air Products Corporation), Zonyl® FSN nonionic surfactant (DuPont), Olin 10G Olin Corporation) and Fluorad® FC431 nonionic surfactant (3M Company).

Additional materials useful in the hydrophilic layer include fillers such as amorphous silica particles (e.g., about 5 $\mu$m in average size) to provide a roughness to the surface that eventually is used for printing. Typically, amorphous silica improves the coatability of the hydrophilic layer onto the support sheet.

The materials in the hydrophilic layer can be applied to the support in any suitable manner using conventional coating equipment and procedures. Upon drying, the coated porous hydrophilic layer typically has a dry coating weight of about 10 g/m$^2$ or more and preferably about 12 g/m$_2$ or more. Typically, the coating weight of the hydrophilic layer is between about 10 g/m$^2$ and about 20 g/m$^2$, and preferably, between about 12 g/m$^2$ and about 16 g/m$^2$.

Thermally Sensitive Imaging Layer

The imaging layer of this invention is thermally sensitive and contains a composition which strongly absorbs infrared radiation which induces a thermal process in the composition to change its physical properties. The imaging layer is micro-porous although visually the coating appears uniform and continuous. In particular, electron micrographs taken with 5 KV electrons at 2000 magnification illustrated that the surface of the uniform polymeric coatings is microporous. The imaging layer of this invention preferably has a coating weight between about 0.3 g/m$^2$ and about 1.5 g/m$^2$.

In one embodiment of this invention, the thermally sensitive composition of the imaging layer contains an acrylic polymer having a plurality of pendent hydrophilic groups; and an infrared absorbing compound. The pendent hydrophilic groups may be a hydroxy, a carboxylic acid, a sulfonic acid, a carboxamide, a sulfonamide, a hydroxymethylamide, an alkoxymethylamide, an epoxy, an oxetane, an amine, or combinations thereof. The acrylic polymer may be one or more copolymers of N-alkoxymethyl methacrylamide, of N-alkoxymethyl acrylamide, or of hydroxy-((1-oxo-2-propenyl)-amino) acetic acid; with $C_1$–$C_{12}$ alkylacryl ate, with $C_1$–$C_{12}$ alkylmethacrylate, with glycidylmethacrylate, with 3,4-epoxy cyclohexyl methyl methacrylate, with 3,4-epoxy cyclohexyl methyl acrylate, with acrylic acid, with methyl methacrylate, and with dimethylaminoethyl methacrylate. Preferably, the acrylic polymer is a copolymer of N-methoxymethyl methacrylamide with 3,4-epoxy cyclohexyl methyl methacrylate, a copolymer of N-methoxymethyl methacrylamide with dimethylaminoethyl methacrylate, or a mixture thereof. The thermally sensitive composition may additionally contain a polymer having phenolic groups, such as a resole resin, a novolac resin, a phenolic polymer containing naphthoquinone diazide groups, a phenolic polymer containing aromatic hydroxymethyl groups, a phenolic polymer containing aromatic alkoxymethyl groups, polyvinylphenol, vinylphenol copolymers, or combinations thereof.

In another embodiment of this invention, the thermally sensitive composition of the imaging layer contains a crosslinking resin system such as an acid catalyzed, crosslinking resin system and a thermally-activated acid generator. In particular, such a system typically contains an acid catalyzed, crosslinking resin system; a thermally-activated acid generator; an infrared absorbing compound; and optionally, an indicator dye. The acid catalyzed, crosslinking resin system comprises an acid catalyzed crosslinkable polymer capable of undergoing an acid-catalyzed polymerization and/or crosslinking reaction, at a temperature in the range of about 60–200° C., to form a crosslinked polymer. In one embodiment of this invention, the crosslinking resin system contains as its sole component an acid catalyzed crosslinkable polymer which contains functional groups which allows crosslinking between polymer chains of the resin system. In another embodiment, the crosslinking resin system contains both the acid catalyzed crosslinkable polymer and a binder resin comprising a polymer containing reactive pendent groups selected from the group consisting of hydroxy, carboxylic acid, sulfonamide, hydroxymethyl amide, and alkoxymethyl amide; wherein the binder resin is capable of undergoing an acid-catalyzed polymerization and/or crosslinking reaction with the acid catalyzed crosslinkable polymer, at a temperature in the range of about 60–200° C., to form the crosslinked polymer. Condensation polymerization compositions of this type are disclosed in Assignee's U.S. patent application Ser. No. 08/745,534 the disclosure of which is incorporated herein by reference.

The binder resin used in the imaging layer of this invention preferably is one or more polymers capable of undergoing an acid-catalyzed condensation reaction with the crosslinking resin at a temperature in the range of about 60 to 200° C. to form a crosslinked polymer. Suitable examples of such polymers include poly(4-hydroxystyrene), poly(4-hydroxystyrene/-methylmethacrylate), novolac resin, poly (2-hydroxyethylmethacrylate/-cyclohexylmethacrylate), poly(2-hydroxyethylmethacrylate/methylmethacrylate), poly(styrene/butylmethacrylate/methylmethacrylate/methacrylic acid), poly(butylmethacrylate/methacrylic acid), poly(vinylphenol/2-hydroxy-ethylmethacrylate), poly (styrene/n-butylmethacrylate/(2-hydroxyethyl methacrylate/methacrylic acid), poly(N-methoxymethylmethylacrylamide/2-phenylethylmethacrylate/methacrylic acid), and poly (styrene/ethylmethacrylate/2-hydroxyethylmethacrylate/methacrylic acid). The binder resin is present in the composition in an amount of 0 to about 65, and preferably up to about 55, weight percent (based on the weight of the composition).

The crosslinking resins used in the imaging layer of this invention preferably are resole resins, $C^1$–$C_5$ alkoxymethyl melamine and glycoluril resins, poly (hydroxymethylstyrene), poly($C_1$–$C_5$-alkoxy-methylstyrene), poly(hydroxymethyl-acrylamide) derivatives, poly($C^1$–$C_5$-alkoxymethyl-acrylamide) derivatives, or combinations thereof. More preferably, the crosslinking resin is selected from the group consisting of resole resins prepared from a $C_1$–$C_5$ alkylphenol and formaldehyde; butylated phenolic resins; tetra-$C_1$–$C_5$ alkoxymethyl glycoluril; and polymers of (hydroxymethylstyrene); of (4-methoxymethyl styrene); of [(N-methoxymethyl) acrylamide]; or of [(N-n-butoxymethyl)acrylamide]. Crosslinking resins which are particularly preferred are acrylic polymers having a plurality of pendent hydrophilic groups which are selected from the group consisting of hydroxy, carboxylic acid, sulfonic acid, carboxamide, sulfonamide, hydroxymethylamide, alkoxymethylamide, epoxy, oxetane, and combinations thereof. Particularly preferred acid catalyzed, crosslinkable polymer resins are one or more copolymers of N-alkoxymethyl methacrylamide, of N-alkoxymethyl acrylamide, or of hydroxy-((1-oxo-2-propenyl)-amino)acetic acid; with $C_1$–$C_{12}$ alkylacrylate, with $C_1$–$C_{12}$ alkylmethacrylate, with glycidylmethacrylate, with 3,4-epoxy cyclohexyl methyl methacrylate, with 3,4-epoxy cyclohexyl methyl acrylate, with acrylic acid, and with methyl methacrylate. A particularly preferred polymer of this type is poly(N-methoxy methyl methacrylamide-co-3,4-epoxy cyclohexyl methyl methacrylate). Typically the preferred acid catalyzed crosslinkable resin also contains polymer containing phenolic groups, such as a resole resin, a novolac resin, a phenolic polymer containing naphthoquinone diazide groups, a phenolic polymer containing aromatic hydroxymethyl groups, a phenolic polymer containing aromatic alkoxymethyl groups, polyvinylphenol, vinylphenol copolymers, and combinations thereof. The crosslinking resin is incorporated into the composition in an amount from about 5 to about 90, and preferably about 10to about 75, weight percent (based on the weight of the composition).

The thermally-activated acid generator used in the imaging layer of this invention promotes the matrix-forming reaction between the crosslinking resin and the binder resin when the layer is exposed to a suitable radiation source. Thermally-activated acid generators suitable for use in this invention include, for example, straight or branched-chain $C^1$–$C_5$ alkyl sulfonates; aryl sulfonates; straight or branched chain N-$C_1$–$C_5$ alkyl sulfonyl sulfonamides; salts containing an onium cation and nonnucleophilic anion; and combinations thereof. Particularly useful salts include those in which the onium cation is selected from the group consisting of an iodonium, a sulphonium, a phosphonium, a oxysulphoxonium, a oxysulphonium, a sulphoxonium, an N-alkoxy ammonium, an ammonium, or a diazonium cation and where the non-nucleophilic anion is selected from the group consisting of tetrafluoroborate, hexafluorophosphate, hexafluoroarsenate, hexafluoroantimonate, triflate, tetrakis (pentafluorophenyl)borate, pentafluoroethylsulfonate, p-methylbenzene sulfonate, ethyl sulfonate, trifluoromethyl acetate, and pentafluoroethyl acetate. Preferred thermally-activated acid generators are diaryliodonium salts. A particularly preferred thermally-activated acid generator is a $C_3$–$C_{20}$ alkoxyphenyl-phenyliodonium salt, or a $C_3$–$C_{20}$ alkoxyphenyl-phenyliodonium salt wherein the alkoxy group is substituted at the 2 position with a hydroxy group such as 2-hydroxy-tetradecyloxyphenyl-phenyliodonium hexafluoroantimonate, or an ester linkage is present in the alkoxy group chain. The thermally-activated acid generator is incorporated in the imaging layer in an amount from about 1 to about 25 weight percent and preferably from about 5 to about 20 weight percent, based on the weight of the composition.

The imaging layer of this invention also requires, as a component, an infrared absorber to render the layer sensitive to infrared radiation and cause the printing plate to be imageable by exposure to a laser source emitting in the infrared region. The infrared absorbing compound may be a dye and/or pigment, typically having a strong absorption band in the region between 700 nm and 1400 nm, and preferably in the region between 780 nm and 1300 nm. A wide range of such compounds is well known in the art and include dyes and/or pigments selected from the group consisting of triarylamine dyes, thiazolium dyes, indolium dyes, oxazolium dyes, cyanine dyes, polyaniline dyes, polypyrrole dyes, polythiophene dyes, thiolene metal complex dyes, carbon black, and polymeric phthalocyanine blue pigments. Examples of the infrared dyes employed in the imaging layer are Cyasorb IR99 (available from Glendale Protective Technology), Cyasorb IR165 (available from Glendale Protective Technology), Epolite 111–178 (available from Epoline), Epolite IV-62B (available from Epoline), PINA-780 (available from Allied Signal), SpectralR830A (available from Spectra Colors Corp.), and SpectralR840A (available from Spectra Colors Corp.). The infrared absorber is used in the imaging layer in an amount from about 2 to about 30 weight percent, percent and preferably from about 5 to about 20 weight percent, based on the weight of the composition.

Other components which can optionally be incorporated into the imaging layer include an indicator dye and a secondary acid generator.

An indicator dye is typically added to the imaging layer to provide a visual image on the exposed plate prior to inking or mounting on the press. Suitable indicator dyes for this purpose include Basic Blue 7, Cl Basic Blue 11, Cl Basic Blue 26, Cl Disperse Red 1, Cl Disperse Red 4, Cl Disperse Red 13, Victoria Blue R, Victoria Blue BO, Solvent Blue 35, and Solvent Blue 36. Preferably the imaging layer contains an indicator dye which is present in an amount of about 0.05 to about 10 weight percent and more preferably from about 0.1 to about 5 weight percent, based on the weight of the composition.

Suitable secondary acid generators are those capable of undergoing an acid-catalyzed thermal decomposition to form additional acid. Secondary acid generators of this type include an acetoacetate, a squaric acid derivative, or an oxalic acid derivative. Particularly useful secondary acid generators include tertbutyl-2-methyl-2-(tosyloxymethyl)-acetoacetate, 2-phenyl-2-(2-tosyloxyethyl)-1,3-dioxolane and a 3,4-dialkoxycyclobut-3-ene-1,2-dione.

To form printing plates of this invention, the compositions typically may be dissolved in an appropriate solvent or solvent mixture, to the extent of about 5 to 15 weight percent based on the weight of the composition. Appropriate solvents or solvent mixtures include methyl ethyl ketone, methanol, methyl lactate, etc. Desirably, the coating solution will also contain a typical silicone-type flow control agent. The porous hydrophilic layer on the sheet substrate may be coated by conventional methods, e.g., roll, gravure, spin, or hopper coating processes, at a rate of about 5 to 15 meters per minute. The coated plate is dried with the aid of an air stream having a temperature from about 60 to about 100° C. for about 0.5 to 10 minutes. The resulting plate will have an imaging layer having a coating weight preferably below about 2 $g/m^2$, and more preferably between about 0.3 and about 1.5 $g/m^2$.

Preparation of the Lithographic Printing Surface:

In the method of this invention, a lithographic printing surface is prepared using a lithographic printing plate as described supra which comprises a sheet substrate; a hydrophilic layer applied to the sheet substrate, wherein the hydrophilic layer has an outer micro-porous surface; the hydrophilic layer comprises about 30 weight % or more of an aluminosilicate or a clay, and the hydrophilic layer has a coating weight of about 5 $g/m^2$ or more; and an imaging layer applied to the hydrophilic layer, wherein the imaging layer is micro-porous and comprises a thermally sensitive composition. The imaging layer is imagewise exposed to infrared radiation to produce an imaged layer; and the imaged layer is treated with a conditioner liquid to produce a lithographic printing surface.

The lithographic printing plates of this invention are imagewise exposed by a radiation source that emits in the infrared region, i.e., between about 700 nm and about 1,400 nm. Preferably, the infrared radiation is laser radiation. Such laser radiation may be digitally controlled to imagewise expose the imaging layer. In this context, the lithographic printing plates of this invention are uniquely adapted for "direct-to-plate" imaging. Direct-to-plate systems utilize digitized information, as stored on a computer disk or computer tape, which is intended to be printed. The bits of information in a digitized record correspond to the image elements or pixels of the image to be printed. The pixel record is used to control an exposure device which may, for example, take the form of a modulated laser beam. The position of the exposure beam, in turn, may be controlled by a rotating drum, a leadscrew, or a turning mirror. The exposure beam is then turned off in correspondence with the pixels to be printed. The exposing beam is focused onto the imaging layer of the unexposed plate.

During the writing operation, the plate to be exposed is placed in the retaining mechanism of the writing device and the write laser beam is scanned across the plate and digitally modulated to generate an image on the surface of the lithographic plate. When an indicator dye is present in the imaging layer a visible image is likewise produced on the surface of the plate.

After imaging exposure the imaged layer of the lithographic printing plate of this invention is treated with a conditioner liquid. Thermal imaging renders the exposed areas ink-receptive; whereas the unexposed areas are rendered ink-repelling by the conditioner liquid. While not being bound by any particular theory, it is postulated that micro-porosity of the image layer facilitates these processes.

The conditioner liquid may be a conventional fountain solution which is applied to the lithographic plate the conventional way on a lithographic printing press. Alternatively, the conditioner liquid may be an aqueous surfactant solution which is applied to the imaged surface, for example by wiping with a solution saturated applicator, and wherein the treated plate is then directly placed on the printing press and the printing operation begun. A unique feature of the lithographic printing plate of this invention is that it can be used directly on a lithographic printing press without such a washout development step required by conventional litho plates. Such a feature further enhances the efficiency of direct-to-plate imaging systems in that it eliminates plate development completely. The aqueous surfactant solution typically has a pH between about 3 and about 13, and contains about 0.2 to about 15 weight percent of a surfactant based on the weight of the conditioner liquid, and preferably between about 2 to about 12 weight percent. The surfactant used in the conditioner liquid preferably is an amphoteric surfactant such as those disclosed in U.S. Pat. No. 3,891,439 the contents of which are incorporated herein by reference. Column 4, lines 21 et seq. of this patent describe amphoteric surfactants which are substituted imidazolines prepared by reacting long chain imidazolines with halogenated or organic intermediates containing carboxyl, phosphoric, or sulfonic acid groups. Amphoteric surfactants of this type are Monaterics available from Mona Industries, Inc., Patterson, N.J., particularly CYNA-50 surfactant. The aqueous surfactant solution may be a conventional fountain solution to which the surfactant has been added or it may be an alkaline solution such as the developer solutions disclosed in U.S. Pat. No. 3,891,439 cited supra. A suitable alkaline solution of this type is a conventional developer, such as the developer disclosed in example 1 of U.S. Pat. No. 3,891,439, which contains about 11% of the imidazoline based amphoteric CYNA-50 surfactant (hereinafter identified as Surfactant Solution I).

The lithographic printing plate of this invention will now be illustrated by the following examples but is not intended to be limited thereby.

EXAMPLE 1

The substrate used for making the lithographic printing plate was Myriad film base, a product of Xante Corporation, Mobile, Ala. Myriad offset substrate is a hydrophilic surface treated polyester film. The hydrophilic surface was analyzed using a FT-IR spectrophotometer and identified as alumino silicate corresponding to $Al_2O_3 \cdot 2SiO_2 \cdot 2H_2O$ and an electron micrograph at 5 KV electrons and 2000 magnification revealed that the hydrophilic surface is microporous.

The polymeric coating solution was prepared by dissolving 4.0 g poly(N-methoxy methyl methacrylamide-co-3,4-epoxy cyclohexyl methyl methacrylate) (80:20 wt %) hereinafter ACR1290 (available from Polychrome Corp.), 2.0 g butylated, thermosetting phenolic resin (GPRI-7550, 75% solid, available from Georgia Pacific), 0.8 g 2-hydroxytetradecyloxyphenyl-phenyliodonium hexafluoroantimonate hereinafter CD1012 (available from Sartomer), 0.8 g SpectralR830A infrared dye (available from Spectra Colors Corp.) and 0.2 g of the indicator dye Solvent Blue 35 (available from Spectra Colors Corp.) into 120 g solvent mixture containing 60% methyl ethyl ketone, 20% methanol, 20% ethyl cellosolve and a trace amount of FC430 surfactant. The solution was spin coated on the hydrophilic surface of the Myriad polyester offset substrate at 85 rpm and dried at 60° C. for 3 minutes to produce a uniform polymeric coating having a coating weight between 0.4 and 1.0 $g/m^2$. An electron micrograph at 5 KV electrons and 2000 magnification revealed that the uniform polymeric coating surface is micro-porous.

The plate was imaged on a Creo Trendsetter thermal plate setter, which was equipped with solid state diode lasers having a wavelength at around 830 nm, at an energy density between 200 and 500 mJ/cm$^2$. An electron micrograph at 5 KV electrons and 2000 magnification revealed that the surface of the imaged uniform polymeric coating is micro-porous at least in the non-imaged areas.

The imaged plate was mounted on press and wetted with Surfactant Solution I (described supra) as a conditioner solution. The plate produced more than 50,000 copies without any deterioration.

EXAMPLE 2

The polymeric coating solution was prepared similar to Example 1, except that SpectralR1060A infrared dye was used to replace SpectralR830A dye. The solution was spin coated on the hydrophilic surface of the Myriad polyester offset substrate and 85 rpm and dried at 60° C. for 3 minutes to produce a uniform polymeric coating having a coating weight between 0.4 and 1.0 g/m$^2$.

The plate was imaged on the Creo Trendsetter thermal plate setter, which was equipped with solid state diode lasers having a wavelength at around 830 nm, at an energy density between 200 and 500 mJ/cm$^2$. The imaged plate was mounted on press and wetted with the conditioner solution of Example 1. The plate produced more than 50,000 copies without any deterioration.

EXAMPLE 3

The polymeric coating solution was prepared similar to Example 1, except that poly(vinylphenol-co-2-hydroxyethylmethacrylate) was used to replace the GPRI-7550 phenolic resin. The solution was spin coated on the hydrophilic surface of the Myriad polyester offset substrate and 85 rpm and dried at 60° C. for 3 minutes to produce a uniform polymeric coating having a coating weight between 0.4 and 1.0 g/m$^2$.

The plate was imaged on the Creo Trendsetter thermal plate setter, which was equipped with solid state diode lasers having a wavelength at around 830 nm, at an energy density between 200 and 500 mJ/cm$^2$. The imaged plate was mounted on press and wetted with a conditioner solution of Example 1. The plate produced more than 50,000 copies without any deterioration.

EXAMPLE 4

The polymeric coating solution was prepared similar to Example 1, except that 0.6 g poly(hydroxy((1-oxo-2-propenyl)amino)acetic acid-co-3,4-epoxy cylohexyl methyl methacrylate) was used to replace poly(N-methoxy methyl methacrylamide-co-3,4-epoxy cyclohexyl methyl methacrylate) copolymer. The solution was spin coated on the hydrophilic surface of the Myriad polyester offset substrate and 85 rpm and dried at 60° C. for 3 minutes to produce a uniform polymeric coating having a coating weight between 0.5 and 1.0 g/m$^2$.

The plate was imaged on the Creo Trendsetter thermal plate setter, which was equipped with solid state diode lasers having a wavelength at around 830 nm, at an energy density between 200 and 500 mJ/cm$^2$. The imaged plate was mounted on press and wetted with a conditioner solution of Example 1. The plate produced more than 50,000 copies without any deterioration.

EXAMPLE 5

The polymeric coating solution was prepared by dissolving 4.0 g ACR1290, 0.8 g CD1012, 0.8 g infrared dye SpectralR830A and 0.2 g indicator dye Solvent Blue 35, into 120 g solvent mixture containing 60% methyl ethyl ketone, 20% methanol, 20% ethyl cellosolve and a trace amount of FC430 surfactant. The solution was spin coated on the Myriad substrate of Example 1 at 85 rpm and dried at 60° C. for 3 minutes to produce a uniform polymeric coating having a coating weight between 0.5 and 1.0 g/m$^2$.

The plate was imaged on the Creo Trendsetter thermal plate setter, which was equipped with solid state diode lasers having a wavelength at around 830 nm, at an energy density between 200 and 500 mJ/cm$^2$. The imaged plate was mounted on press and wetted with a conditioner solution Example 1. The plate produced more than 50,000 copies without any deterioration.

EXAMPLE 6

A lithographic printing plate was prepared and imaged as described in Example 1. The imaged plate was mounted on a press supplied with a conventional fountain solution to which 4 weight % of CYNA 50 (an amphoteric surfactant available from Mona Industries, Patterson, N.J.) had been added. After the initial start-up, impressions were made. The plate produced more than 50,000 copies without any deterioration.

EXAMPLE 7

A polymeric coating was prepared by dissolving 4.0 g poly(N-methoxymethyl methacrylamide-co-dimethylaminoethyl methacrylate) (80:20 wt %) hereinafter ACR 1356 (available from Kodak Polychrome Graphics), 2.1 g of butylated thermosetting phenolic resin (GPRI 7550 available from Georgia Pacific), 0.9 g ADS 830 dye (available from American Dye Source), and 0.15 g indicator dye Solvent Blue 35 (available from Spectra Colors Corp.) into 100 g of a solvent mixture containing by weight 60% methyl ethyl ketone, 20% methanol, 20% methyl cellosolve, and FC430 fluorocarbon surfactant in trace amounts. The solution was then spin coated on the hydrophilic surface of the Myriad polyester offset substrate of Example 1 at 85 rpm and dried at 60° C. for three minutes to produce a uniform coating having a coated weight between 0.8–1.2 g/m$^2$. An electron micrograph at 5 KV electrons and 2000 magnification revealed that the uniform polymeric coating surface is micro-porous.

The plate was imaged on the Creo Trendsetter thermal plate setter, which was equipped with solid state diode lasers having a wavelength at around 830 nm, at an energy density between 200 and 500 mJ/cm$^2$. The imaged plate was mounted on press and wetted with an acidic fountain solution at pH 4–5. The plate produced more than 50,000 copies without any deterioration.

EXAMPLE 8

A polymeric coating was prepared by dissolving 2.0 g ACR 1356 (available from Kodak Polychrome Graphics), 3.2 g of napthoquinone diazide polymer (P3000 available from Kodak Polychrome Graphics), 0.9 g ADS 830 dye (available from American Dye Source), and 0.15 g indicator dye Solvent Blue 35 (available from Spectra Colors Corp.) into 100 g of a solvent mixture containing by weight 60% methyl ethyl ketone, 20% methanol, 20% methyl cellosolve, and FC430 fluorocarbon surfactant in trace amounts. The solution was then spin coated on the hydrophilic surface of the Myriad polyester offset substrate of Example 1 at 85 rpm and dried at 60° C. for three minutes to produce a uniform coating having a coated weight between 0.8–1.2 g/m$^2$. An electron micrograph at 5 KV electrons and 2000 magnification revealed that the uniform polymeric coating surface is micro-porous.

The plate was imaged on the Creo Trendsetter thermal plate setter, which was equipped with solid state diode lasers having a wavelength at around 830 nm, at an energy density between 200 and 500 mJ/cm$^2$. The imaged plate was mounted on press and wetted with an acidic fountain solution at pH 4–5. The plate produced more than 50,000 copies without any deterioration.

EXAMPLE 9

A polymeric coating was prepared by dissolving 4.0 g ACR 1356 (available from Kodak Polychrome Graphics), 1.05 g of cresol novolac resin (SD-126A available from Borden Chemicals Inc.), 1.05 g of cresol novolac resin (SD-443A available from Borden Chemicals Inc.), 0.9 g ADS 830 dye (available from American Dye Source), and 0.15 g indicator dye Solvent Blue 35 (available from Spectra Colors Corp.) into 100 g of a solvent mixture containing by weight 60% methyl ethyl ketone, 20% methanol, 20% methyl cellosolve, and FC430 fluorocarbon surfactant in trace amounts. The solution was then spin coated on the hydrophilic surface of the Myriad polyester offset substrate of Example 1 at 85 rpm and dried at 60° C. for three minutes to produce a uniform coating having a coated weight between 0.8–1.2 g/m$^2$. An electron micrograph at 5 KV electrons and 2000 magnification revealed that the uniform polymeric coating surface is micro-porous.

The plate was imaged on the Creo Trendsetter thermal plate setter, which was equipped with solid state diode lasers having a wavelength at around 830 nm, at an energy density between 200 and 500 mJ/cm$^2$. The imaged plate was mounted on press and wetted with an acidic fountain solution at pH 4–5. The plate produced more than 50,000 copies without any deterioration.

EXAMPLE 10

A polymeric coating was prepared by dissolving 2.0 g ACR 1356 (available from Kodak Polychrome Graphics) 2.0 g ACR 1290 (available from Kodak Polychrome Graphics), 2.1 g of butylated thermosetting phenolic resin (GPRI 7550 available from Georgia Pacific), 0.9 g ADS 830 dye (available from American Dye Source), and 0.15 g indicator dye Solvent Blue 35 (available from Spectra Colors Corp.) into 100 g of a solvent mixture containing by weight 60% methyl ethyl ketone, 20% methanol, 20% methyl cellosolve, and FC430 fluorocarbon surfactant in trace amounts. The solution was then spin coated on the hydrophilic surface of the Myriad polyester offset substrate of Example 1 at 85 rpm and dried at 60° C. for three minutes to produce a uniform coating having a coated weight between 0.8–1.2 g/m$^2$. An electron micrograph at 5 KV electrons and 2000 magnification revealed that the uniform polymeric coating surface is micro-porous.

The plate was imaged on the Creo Trendsetter thermal plate setter, which was equipped with solid state diode lasers having a wavelength at around 830 nm, at an energy density between 200 and 500 mJ/cm$^2$. The imaged plate was mounted on press and wetted with an acidic fountain solution at pH 4–5. The plate produced more than 50,000 copies without any deterioration.

EXAMPLE 11

A polymeric coating was prepared by dissolving 4.1 g ACR 1356 (available from Kodak Polychrome Graphics), 12.3 g of Aquabead Wax (available from Micro Powders), 0.9 g ADS 830 dye (available from American Dye Source), and 0.15 g indicator dye Solvent Blue 35 (available from Spectra Colors Corp.) into 230 g of a solvent mixture containing by weight 60% methyl ethyl ketone, 20% methanol, 20% methyl cellosolve, and FC430 fluorocarbon surfactant in trace amounts. The solution was then spin coated on the hydrophilic surface of the Myriad polyester offset substrate of Example 1 at 85 rpm and dried at 60° C. for three minutes to produce a uniform coating having a coated weight between 0.8–1.2 g/m$^2$. An electron micrograph at 5 KV electrons and 2000 magnification revealed that the uniform polymeric coating surface is micro-porous.

The plate was imaged on the Creo Trendsetter thermal plate setter, which was equipped with solid state diode lasers having a wavelength at around 830 nm, at an energy density between 200 and 500 mJ/cm$^2$. The imaged plate was mounted on press and wetted with an acidic fountain solution at pH 4–5. The plate produced more than 50,000 copies without any deterioration.

EXAMPLE 12

A polymeric coating was prepared by dissolving 4.0 g ACR 1356 (available from Kodak Polychrome Graphics), 2.1 g of butylated thermosetting phenolic resin (GPRI 7550 available from Georgia Pacific), 0.9 g ADS 830 dye (available from American Dye Source), and 0.15 g indicator dye Solvent Blue 35 (available from Spectra Colors Corp.) into 120 g of a solvent mixture containing by weight 60% methyl ethyl ketone, 20% methanol, 20% methyl cellosolve, and FC430 fluorocarbon surfactant in trace amounts. The solution was then spin coated on the hydrophilic surface of the Myriad polyester offset substrate of Example 1 at 85 rpm and dried at 60° C. for three minutes to produce a uniform coating having a coated weight between 0.8–1.2 g/m$^2$. An electron micrograph at 5 KV electrons and 2000 magnification revealed that the uniform polymeric coating surface is micro-porous.

The plate was imaged on the Creo Trendsetter thermal plate setter, which was equipped with solid state diode lasers having a wavelength at around 830 nm, at an energy density between 200 and 500 mJ/cm$^2$. The imaged plate was mounted on press and wetted with an acidic fountain solution at pH 4–5. The plate produced more than 50,000 copies without any deterioration.

EXAMPLE 13

In this example the term "wt. %" is intended to mean the weight % of the component designated based on the total weight of components, i.e., "solids", exclusive of water or any solvents used to disperse or coat the mixture.

A hydrophilic layer on a sheet substrate was prepared as follows: A hydrophilic coating mixture was prepared by mixing 160 g (18.6 wt. %) Ludox SM30 (30% colloidal silica aqueous solution, available from DuPont), 408 g (7.9 wt. %) Methocel K100LV (4.8% hydroxypropyl methylcellulose aqueous solution, available from Dow Chemical), 80 g (31 wt. %) kaolin (china)clay, (a mixture of metal oxides having aluminum oxide 26% and silicon oxide 25%, and an average particle size of 0.4 $\mu$; available from Aldrich), 80 g (31 wt. %) kaolin clay, (a mixture of metal oxides having aluminum oxide 34 % and silicon oxide 51 %, and an average particle size of 1 $\mu$; available from Across), 16 g (6.2 wt. %) Syloid 7000 (amorphous silica available from W.R. Grace), 13 g (5 wt. %)surfactant CT-121 (available from Air Products), and 319 g water. This coating mixture was mixed for 48 hours in a ceramic ball mill with ceramic shots (weight of shots, 1614 g). Tetramethoxysilane (8 ml) was added to 950 g of the mixture, which was subsequently coated onto a grained and silicated aluminum sheet using a #5 wire-wound rod. After drying in an oven at 125° C. for ca. 10 minutes, the porous hydrophilic coating weight was 12 g/m$^2$, and a surface roughness of 0.9–1.1 $\mu$m.

A polymeric coating solution was prepared by dissolving 4.0 g poly(N-methoxymethyl methacrylamide-co-dimethylaminoethyl methacrylate) (80:20 wt %) hereinafter ACR1356 (available from Polychrome Corp.), 2.1 g of butylated, thermosetting phenolic resin (GPRI-7550, 75% solid, available from Georgia Pacific), 0.9 g ADS 830 dye and 0.15 g of the indicator dye Solvent Blue 35 (available from Spectra Colors Corp.) into 120 g solvent mixture containing 60% methyl ethyl ketone, 20% methanol, 20% methyl cellosolve and a trace amount of FC430 surfactant. The solution was spin coated on the hydrophilic surface of the above coated aluminum substrate at 85 rpm and dried at 60° C. for 3 minutes to produce a uniform polymeric coating having a coating weight between 0.8 and 1.2 g/m$^2$.

The plate was imaged on a Creo Trendsetter thermal plate setter, which was equipped with solid state diode lasers having a wavelength at around 830 nm, at an energy density between 200 and 500 mJ/cm$^2$. The imaged plate was mounted on press and wetted with an acidic fountain solution at pH 4–5. The plate produced more than 20,000 copies without any deterioration.

Those skilled in the art having the benefit of the teachings of the present invention as hereinabove set forth, can effect numerous modifications thereto. These modifications are to be construed as being encompassed within the scope of the present invention as set forth in the appended claims.

What is claimed is:

1. A negative-working, thermally imageable, lithographic printing plate comprising:

(a) a sheet substrate;

(b) a hydrophilic layer applied to the sheet substrate, wherein the hydrophilic layer comprises about 30 weight % or more of a clay based on the weight of the hydrophilic layer, and wherein the hydrophilic layer has a coating weight of about 5 g/m$^2$ or more; and (c) an imaging layer applied to the hydrophilic layer, wherein the imaging layer comprises a thermally sensitive composition.

2. The lithographic printing plate of claim 1 wherein the sheet substrate is a dimensionally stable, polymeric sheet, a metal sheet, a paper sheet, or a laminate thereof.

3. The lithographic printing plate of claim 2 wherein the sheet substrate is a polyethylene terephthalate film.

4. The lithographic printing plate of claim 2 wherein the sheet substrate is an aluminum plate.

5. The lithographic printing plate of claim 1 wherein coating weight of the hydrophilic layer is about 10 g/m$^2$ or more.

6. The lithographic printing plate of claim 1 wherein the hydrophilic layer has an outer micro-porous surface.

7. The lithographic printing plate of claim 1 wherein the hydrophilic layer further comprises a crosslinked hydrophilic binder which is a product of a reaction of a water-soluble binder with a hardening agent.

8. The lithographic printing plate of claim 7 wherein the water-soluble binder is a gelatin, a gelatin derivative, a cellulosic material, a vinyl pyrrolidone polymer, an acrylamide polymer, a polyvinyl alcohol, an agar, an algin, a carrageenan, a fucoidan, a laminaran, a gum arabic, a cornhull gum, a gum ghatti, a guar gum, a karaya gum, a locust bean gum, a pectin, a dextran, a starch or a polypeptide.

9. The lithographic printing plate of claim 7 wherein the hardening agent is a silane having two or more hydroxy groups, alkoxy groups, acetoxy groups, or a combination thereof.

10. The lithographic printing plate of claim 9 wherein the hardening agent is aminopropyltriethoxysilane, glycidoxypropyltriethoxysilane, or tetramethoxysilane.

11. The lithographic printing plate of claim 7 wherein the hydrophilic layer further comprises colloidal silica.

12. The lithographic printing plate of claim 1 wherein the clay is a kaolin, a serpentine, a montmorillonite, an illite, a glauconite, a chlorite, a vermiculite, a bauxite, an attapulgite, a sepiolite, a palgorskite, an allophane, an imogolite, a diaspore, a boehmite, a gibbsite, a cliachite, a laponite, a hydrotalcite, or any mixture thereof.

13. The lithographic printing plate of claim 1 wherein the clay is an aluminosilicate.

14. The lithographic printing plate of claim 13 wherein the aluminosilicate is $Al_2O_3 \cdot 2SiO_2 \cdot 2H_2O$.

15. The lithographic printing plate of claim 1 wherein the imaging layer is micro-porous.

16. The lithographic printing plate of claim 1 wherein the imaging layer has a coating weight between about 0.3 and about 1.5 grams per square meter.

17. The lithographic printing plate of claim 1 wherein the thermally sensitive composition comprises:

(1) an acrylic polymer having a plurality of pendent hydrophilic groups; and (2) an infrared absorbing compound.

18. The lithographic printing plate of claim 17 wherein the pendent hydrophilic groups are selected from the group consisting of hydroxy, carboxylic acid, sulfonic acid, carboxamide, sulfonamide, hydroxymethylamide, alkoxymethylamide, epoxy, oxetane, amine, and combinations thereof.

19. The lithographic printing plate of claim 17 wherein the acrylic polymer is one or more copolymers of N-alkoxymethyl methacrylamide, of N-alkoxymethyl acrylamide, or of hydroxy-((1-oxo-2-propenyl)-amino) acetic acid; with $C_1$–$C_{12}$ alkylacrylate, with $C_1$–$C_{12}$ alkylmethacrylate, with glycidylmethacrylate, with 3,4-epoxy cyclohexyl methyl methacrylate, with 3,4-epoxy cyclohexyl methyl acrylate, with acrylic acid, with methyl methacrylate, and with dimethylaminoethyl methacrylate.

20. The lithographic printing plate of claim 19 wherein the acrylic polymer is a copolymer of N-methoxymethyl methacrylamide with 3,4-epoxy cyclohexyl methyl methacrylate, a copolymer of N-methoxymethyl methacrylamide with dimethylaminoethyl methacrylate, or a mixture thereof.

21. The lithographic printing plate of claim 17 wherein the thermally sensitive composition contains a polymer containing phenolic groups.

22. The lithographic printing plate of claim 21 wherein the polymer containing phenolic groups is selected from the group consisting of a resole resin, a novolac resin, a phenolic polymer containing naphthoquinone diazide groups, a phenolic polymer containing aromatic hydroxymethyl groups, a phenolic polymer containing aromatic alkoxymethyl groups, polyvinylphenol, vinylphenol copolymers, and combinations thereof.

23. The lithographic printing plate of claim 17 wherein the thermally sensitive composition comprises a crosslinking resin system.

24. The lithographic printing plate of claim 23 wherein the thermally sensitive composition comprises an acid catalyzed, crosslinking resin system and a thermally-activated acid generator.

25. The lithographic printing plate of claim 23 wherein the acid catalyzed, crosslinking resin system comprises an acid catalyzed crosslinkable polymer capable of undergoing an acid-catalyzed condensation reaction, at a temperature in the range of about 60–200° C., to form a crosslinked polymer.

26. The lithographic printing plate of claim 25 wherein the acid catalyzed, crosslinkable polymer is one or more copolymers of N-alkoxymethyl methacrylamide, of N-alkoxymethyl acrylamide, or of hydroxy-((1-oxo-2-propenyl)-amino) acetic acid; with $C_1$–$C_{12}$ alkylacrylate, with $C_1$–$C_{12}$ alkylmethacrylate, with glycidylmethacrylate, with 3,4-epoxy cyclohexyl methyl methacrylate, with 3,4-epoxy cyclohexyl methyl acrylate, with acrylic acid, and with methyl methacrylate.

27. The lithographic printing plate of claim 25 wherein the acid catalyzed, crosslinkable polymer is a polymer containing phenolic groups.

28. The lithographic printing plate of claim 27 wherein the polymer containing phenolic groups is selected from the group consisting of a resole resin, a novolac resin, a phenolic polymer containing naphthoquinone diazide groups, a phenolic polymer containing aromatic hydroxymethyl groups, a phenolic polymer containing aromatic alkoxymethyl groups, polyvinylphenol, vinylphenol copolymers, and combinations thereof.

29. The lithographic printing plate of claim 24 wherein the thermally-activated acid generator is selected from the group consisting of straight or branched-chain $C_1$–$C_5$ alkyl sulfonates; aryl sulfonates; straight or branched chain N-$C_1$–$C_5$ alkyl sulfonyl sulfonamides; salts containing an onium cation and nonnucleophilic anion; and combinations thereof.

30. The lithographic printing plate of claim 29 wherein the salt contains a non-nucleophilic anion selected from the group consisting of tetrafluoroborate, hexafluorophosphate, hexafluoroarsenate, hexafluoroantimonate, triflate, tetrakis (pentafluorophenyl)borate, pentafluoroethylsulfonate, p-methylbenzene sulfonate, ethyl sulfonate, trifluoromethyl acetate, and pentafluoroethyl acetate.

31. The lithographic printing plate of claim 24 wherein the thermally-activated acid generator is a salt containing an iodonium, a sulphonium, a phosphonium, a oxysulphoxonium, a oxysulphonium, a sulphoxonium, an N-alkoxyammonium, an ammonium, or a diazonium cation.

32. The lithographic printing plate of claim 24 wherein the thermallyactivated acid generator is 2-hydroxy-tetradecyloxyphenyl-phenyliodonium hexafluoroantimonate.

33. The lithographic printing plate of claim 24 wherein the thermally sensitive composition further comprises a secondary acid generator capable of undergoing an acid-catalyzed reaction to form additional acid.

34. The lithographic printing plate of claim 1 wherein the thermally sensitive composition contains an infrared absorbing compound; and optionally, an indicator dye.

35. The lithographic printing plate of claim 34 wherein the infrared absorbing compound is a dye and/or pigment having a strong absorption band in the region between 700 nm and 1400 nm.

36. The lithographic printing plate of claim 34 wherein the infrared absorbing compound is selected from the group consisting of triarylamine dyes, thiazolium dyes, indolium dyes, oxazolium dyes, cyanine dyes, polyaniline dyes, polypyrrole dyes, polythiophene dyes, thiolene metal complex dyes, carbon black, and polymeric phthalocyanine blue pigments.

37. The lithographic printing plate of claim 34 wherein the indicator dye is present in the imaging layer, and wherein the indicator dye is selected from the group consisting of Victoria Blue R, Victoria Blue BO, Solvent Blue 35, and Solvent Blue 36.

38. A method for preparing a lithographic printing surface consisting essentially of the steps:

A. providing a negative-working, thermally sensitive, lithographic printing plate comprising:

(a) a sheet substrate;

(b) a hydrophilic layer applied to the sheet substrate, wherein the hydrophilic layer comprises about 30 weight % or more of an or a clay based on the weight of the hydrophilic layer, and wherein the hydrophilic layer has a coating weight of about 5 g/m$^2$ or more; and, (c) an imaging layer applied to the hydrophilic layer, wherein the imaging layer comprises a thermally sensitive composition;

B. exposing imagewise the imaging layer to infrared radiation to produce an imaged layer; and C. treating the imaged layer with a conditioner liquid to produce a lithographic printing surface.

39. The method of claim 38 wherein the infrared radiation is laser radiation.

40. The method of claim 39 wherein the laser radiation is digitally controlled to imagewise expose the imaging layer.

41. The method of claim 38 wherein the conditioner liquid is an aqueous surfactant solution.

42. The method of claim 41 wherein the conditioner liquid contains an amphoteric surfactant.

43. The method of claim 42 wherein the amphoteric surfactant is an imidazoline based surfactant.

44. The method of claim 41 wherein the conditioner liquid contains about 0.2 to about 15 weight percent of a surfactant based on the weight of the conditioner liquid.

45. The method of claim 38 wherein the conditioner liquid has a pH between about 3 and about 13.

46. The method of claim 45 wherein the conditioner liquid is an alkaline solution.

47. The method of claim 38 wherein the conditioner liquid is a fountain solution.

48. The method of claim 38 wherein the thermally sensitive composition consists essentially of (1) an acid catalyzed, crosslinking resin system;

(2) a thermally-activated acid generator;

(3) an infrared absorbing compound; and optionally, (4) an indicator dye.

49. A negative-working, thermally imageable, lithographic printing plate comprising:

(a) a polymeric sheet substrate;

(b) a hydrophilic layer applied to the sheet substrate, wherein the hydrophilic layer comprises about 30 weight % or more of an aluminosilicate based on the weight of the hydrophilic layer, and wherein the hydrophilic layer has a coating weight of about 5 g/m$^2$ or more; and (c) an imaging layer applied to the hydrophilic layer, wherein the imaging layer comprises a thermally sensitive composition and is micro-porous.

50. The lithographic printing plate of claim 49 wherein the hydrophilic layer consists essentially of an aluminosilicate.

51. The lithographic printing plate of claim 50 wherein the polymeric sheet substrate is a polyethylene terephthalate film.

52. The lithographic printing plate of claim 50 wherein coating weight of the hydrophilic layer is about 10 $g/m^2$ or more.

53. The lithographic printing plate of claim 50 wherein the hydrophilic layer has an outer micro-porous surface.

54. The lithographic printing plate of claim 50 wherein the hydrophilic layer further comprises a crosslinked hydrophilic binder which is a product of a reaction of a water-soluble binder with a hardening agent.

55. The lithographic printing plate of claim 54 wherein the water-soluble binder is a gelatin, a gelatin derivative, a cellulosic material, a vinyl pyrrolidone polymer, an acrylamide polymer, a polyvinyl alcohol, an agar, an algin, a carrageenan, a fucoidan, a laminaran, a gum arabic, a cornhull gum, a gum ghatti, a guar gum, a karaya gum, a locust bean gum, a pectin, a dextran, a starch or a polypeptide.

56. The lithographic printing plate of claim 54 wherein the hardening agent is a silane having two or more hydroxy groups, alkoxy groups, acetoxy groups, or a combination thereof.

57. The lithographic printing plate of claim 54 wherein the hydrophilic layer further comprises colloidal silica.

58. The lithographic printing plate of claim 50 wherein the aluminosilicate is $Al_2O_3 \cdot 2SiO_2 \cdot 2H_2O$.

59. The lithographic printing plate of claim 50 wherein the imaging layer has a coating weight between about 0.3 and about 1.5 grams per square meter.

60. The lithographic printing plate of claim 50 wherein the thermally sensitive composition comprises:

(1) an acrylic polymer having a plurality of pendent hydrophilic groups; and (2) an infrared absorbing compound.

61. The lithographic printing plate of claim 60 wherein the thermally sensitive composition contains a polymer containing phenolic groups.

62. The lithographic printing plate of claim 60 wherein the thermally sensitive composition comprises a crosslinking resin system.

63. The lithographic printing plate of claim 50 wherein the thermally sensitive composition contains an infrared absorbing compound; and optionally, an indicator dye.

* * * * *

UNITED STATES PATENT AND TRADEMARK OFFICE

CERTIFICATE OF CORRECTION

PATENT NO. : 6,261,740 B1
DATED : July 17, 2001
INVENTOR(S) : Nguyen et al.

It is certified that error appears in the above-identified patent and that said Letters Patent is hereby corrected as shown below:

Column 17,
Line 5, delete "23" and insert therefor -- 24 --.

Signed and Sealed this

Twenty-ninth Day of January, 2002

*Attest:*

*Attesting Officer*

JAMES E. ROGAN
*Director of the United States Patent and Trademark Office*